US006263903B1

(12) United States Patent
Sjöberg

(10) Patent No.: US 6,263,903 B1
(45) Date of Patent: Jul. 24, 2001

(54) ARRANGEMENT FOR UNDERGROUND STOP VALVE

(76) Inventor: Thomas Sjöberg, Solhemsgatan 48, 283 32 Osby (SE)

( * ) Notice: Subject to any disclaimer, the term of this patent is extended or adjusted under 35 U.S.C. 154(b) by 0 days.

(21) Appl. No.: 09/467,009

(22) Filed: Dec. 20, 1999

Related U.S. Application Data

(63) Continuation of application No. PCT/SE98/01121, filed on Jun. 11, 1998.

(30) Foreign Application Priority Data

Jun. 19, 1997 (SE) ..... 9702339

(51) Int. Cl.[7] ..... F16L 5/00

(52) U.S. Cl. ..... 137/364; 137/240; 137/271; 137/363; 137/367; 137/368; 137/557; 137/559; 251/291; 251/293; 138/121

(58) Field of Search ..... 137/363, 364, 137/367, 368, 271, 240, 559, 557, 269; 251/291, 293; 73/40.5 R, 49.1; 138/121

(56) References Cited

U.S. PATENT DOCUMENTS

| | | | | |
|---|---|---|---|---|
| 2,827,914 | * | 3/1958 | Alters | 137/364 |
| 3,693,647 | * | 9/1972 | Saar | 137/363 |
| 3,820,558 | * | 6/1974 | Mueller | 137/269 |
| 3,871,400 | * | 3/1975 | Thastrup | 137/363 |
| 4,352,532 | * | 10/1982 | Hardin | 439/191 |
| 4,643,218 | * | 2/1987 | Reed, Jr. | 137/237 |
| 4,702,275 | * | 10/1987 | Ballun et al. | 137/556 |
| 4,708,160 | * | 11/1987 | Sharp et al. | 137/368 |
| 5,370,146 | * | 12/1994 | King et al. | 137/8 |
| 5,609,324 | * | 3/1997 | Pinkney | 251/292 |
| 5,794,644 | * | 8/1998 | Paylor | 137/15 |
| 5,816,284 | * | 10/1998 | Lin | 137/223 |
| 5,823,222 | * | 10/1998 | Minshull et al. | 137/15 |
| 5,890,515 | * | 4/1999 | Spiess et al. | 137/552 |
| 6,012,485 | * | 1/2000 | Connelly et al. | 137/558 |
| 6,079,451 | * | 6/2000 | Hegler | 138/121 |
| 6,089,264 | * | 7/2000 | Spiess | 137/559 |

* cited by examiner

*Primary Examiner*—A. Michael Chambers
*Assistant Examiner*—Thomas L. McShane
(74) *Attorney, Agent, or Firm*—Browdy and Neimark

(57) ABSTRACT

An arrangement intended for a stop valve (1) comprises a tubular member (9). The stop valve (1) is located in the ground (2) and has a valve housing (11) and a valve bonnet (12) fixed thereto with the aid of a fixing means (14), said valve bonnet having a valve spindle (15) supporting a movable stop means (16), such as a slide. The tubular member (9) extends from the valve (1) up to ground level to enable operation of the valve spindle (15). A collar means (10') is tightly connected with and supported by the valve housing (11). The collar means (10') has a collar portion (32) which surrounds the valve bonnet (12) and the fixing means (14) and is tightly connected with the lower end of the tubular member (9), the diameter of the tubular member (9) essentially corresponding to the diameter of the collar portion (32). Moreover, the arrangement comprises a pipe access means (12'), which instead of the valve bonnet (12) from ground level is tightly mountable on said valve housing (11).

11 Claims, 5 Drawing Sheets

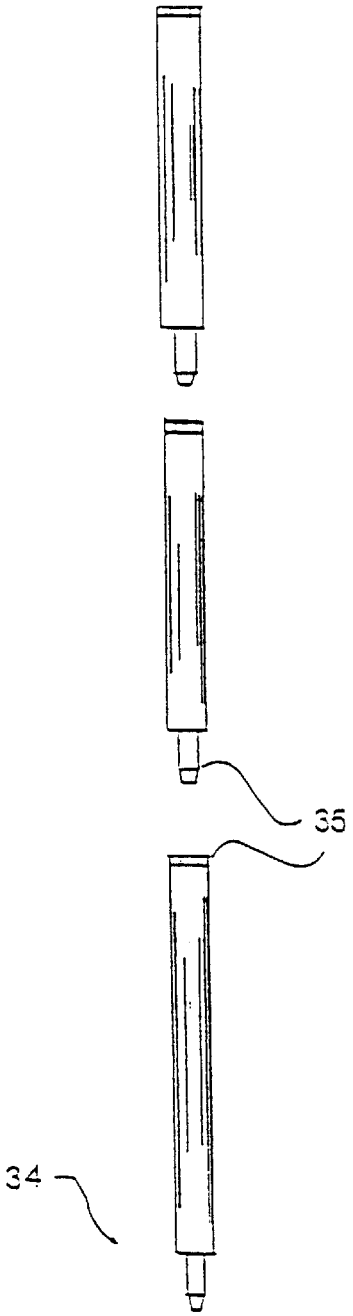
Fig. 6
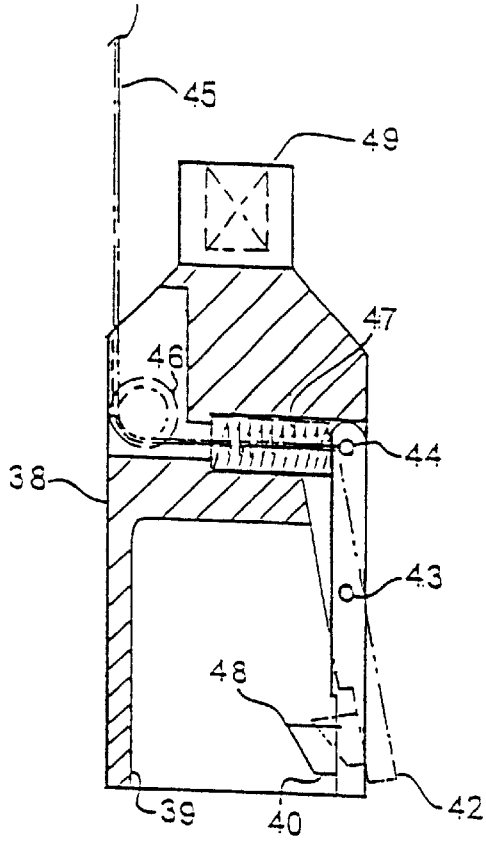
Fig. 7
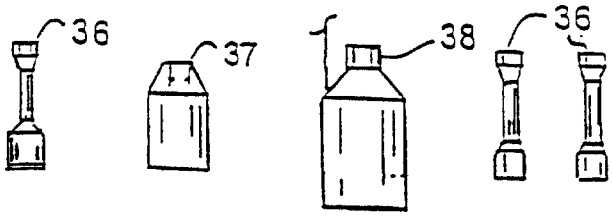

ARRANGEMENT FOR UNDERGROUND STOP VALVE

This application is a continuation of PCT/SE98/01121 filed Jun. 11, 1998.

FIELD OF THE INVENTION

The present invention relates to an arrangement for a stop valve, which is located in the ground and is connected to a pipeline system laid in the ground, said arrangement comprising on the one hand a valve housing and a valve bonnet which is fixed thereto with the aid of a fixing means and which has a valve spindle supporting a movable stop means, such as a slide, and, on the other hand, a tubular member extending from the valve up to ground level to enable operation of the valve spindle, and a collar means which is tightly connected with and supported by the valve housing and has a collar portion which surrounds the valve bonnet and the fixing means and is tightly connected with the lower end of the tubular member, the diameter of the tubular member essentially corresponding to the diameter of the collar portion.

BACKGROUND ART

This type of arrangement is especially intended for so-called service valves that are used to control flows of water in municipal water mains, but also in connection with other types of valves placed in the ground. The selected term "stop valve" is therefore to be interpreted in its widest sense, i.e. to include also e.g. control valves of different types.

A drawback of many prior-art stop valves is that they are used relatively rarely and therefore, after being in use for some time, tend to jam or be clogged. The jamming part generally is the actual stop means of the valve, which in most cases is a slide adapted to run in a corresponding seat in the valve housing. The slide is supported and operated by means of a valve spindle mounted in a valve bonnet. The valve bonnet is arranged on top of the valve housing and is, by means of bolts and an intermediate seal, tightly arranged on top of the valve housing. The valve spindle extends in a sealed manner through the valve bonnet and has an upper end intended to engage a wrench rod, by means of which the valve spindle can be rotated.

Before arrangements of the type briefly described above came into use, it was necessary to dig up a jamming valve for cleaning or renovating. With arrangements of the type at issue, of which one is disclosed in GB-A-2,118,687, in which also a tool is described for use in connection with renovation of valves, this is no longer necessary.

OBJECT OF THE INVENTION

In view of GB-A-2,118,687, the object of the present invention is to further develop the known solution and to provide an arrangement which in relation to this solution gives further advantages when working with underground stop valves.

SUMMARY OF THE INVENTION

According to the invention, this object is achieved by the arrangement according to the preamble further comprising a pipe access means, which instead of the valve bonnet is tightly mountable on said valve housing from ground level.

As mentioned by way of introduction, it is for cleaning and service of stop valves as a rule necessary to remove only the valve bonnet including the associated parts. The choice of a great diameter for the tubular member and a tight connection thereof with a collar of the valve housing makes it possible according to prior-art solutions to relatively easily loosen, take up and renovate or exchange the jamming parts of a stop valve by means of suitable tools from ground level via the tubular member, and then again install them without necessitating any digging operation, which results in considerable saving of time and cost. According to the invention, the technique of the prior-art solution is now used to carry out in a smooth manner the remaining operations in connection with a pipeline system located in the ground by this system being made accessible via the valve housing for various measures.

The used pipe access means can according to the invention be a tube coupling, which for hydrostatic testing or cleaning of the pipeline system enables connection of a tube which is connected to a source of pressure with a pressure gauge The solution is advantageous since it allows hydrostatic testing of limited portions of piping, for instance, by closing two stop valves belonging to a piping portion and, by means of the inventive arrangement, pressurising a third valve located between the two first mentioned valves.

Alternatively, the pipe access means can be a flow meter, which, for measuring the flow of a medium flowing through the pipeline system, has a measuring cell, which in the valve housing takes the place intended for the stop means. Also in this solution, the advantage resides in the fact that limited portions of piping can be examined, in this case in respect of existing flows.

A further alternative is that the pipe access means is a hydrant, which for controllable pumping out of water flowing through the pipeline system has an integral stop valve and at least one tube connection. This alternative is useful, when, for instance, building operations make it impossible to use an existing hydrant, or require a completely new hydrant, for instance, for reasons of fire safety in connection with new, permanent or temporary arrangements.

In yet another alternative, the pipe access means is an insertion shaft which is adapted to guide an object, such as a video camera or a cleaning spiral with an associated nozzle, inserted from ground level into the insertion shaft, in the desired direction into the pipeline system. Also this alternative is particularly useful in limited piping portions adjacent to, for instance, a probable source of error.

Preferably, the tubular member comprises a pipe which is corrugated transversely of its longitudinal direction and thus is elastically yieldable in said longitudinal direction. Such a pipe is intended for use especially in geographic areas with ground frost which, as the ground moves, may cause pipe bursts.

According to an embodiment of the present invention, the collar means is integrated with the valve housing. This embodiment thus requires manufacture of a special valve housing but has obvious advantages by being easy to mount.

In another embodiment of the invention, the collar means has an end wall, which is placed between the valve bonnet and the valve housing and through which extend the valve spindle and the fixing means, which consists of bonnet bolts. This embodiment is also suitable for use together with prior-art valves and for use with valves that have been dug up for renovation.

The inventive arrangement preferably also comprises a tool, which has a tool shaft, whose length at least corresponds to the length of the tubular member, and a tool head which is adapted to raise the valve bonnet and which has a recess corresponding to a projecting stud of the valve spindle, and a pin which is movable transversely of the longitudinal direction of the valve spindle and which is adapted to engage, in an engaging position, in a corresponding hole in said stud. This tool, which is adapted to cooperate with a valve having on the valve spindle a stud adapted to the tool, has been found to function excellently because the relatively rigid connection between the tool and the stud makes it possible to prize a jamming valve bonnet loose.

Finally, the pin of the tool head is, preferably by means of a spring, biased towards its engaging position, and said pin is, by means of a pull wire whose length at least corresponds to the length of the tubular member, disengageable from the hole in the stud of the valve spindle. It has in practical experiments been found that also such a simple tool well satisfies even stringent requirements as regards user friendliness.

BRIEF DESCRIPTION OF THE DRAWINGS

Preferred embodiments of the inventive arrangement will now be described in more detail with reference to the accompanying drawings, in which

FIG. 6 is a general view and shows variants of a tool intended for the inventive arrangement; and FIG. 7 is a sectional view of a tool head for one of the variants in FIG. 6 in detail.

DESCRIPTION OF EMBODIMENTS

Figure 1:
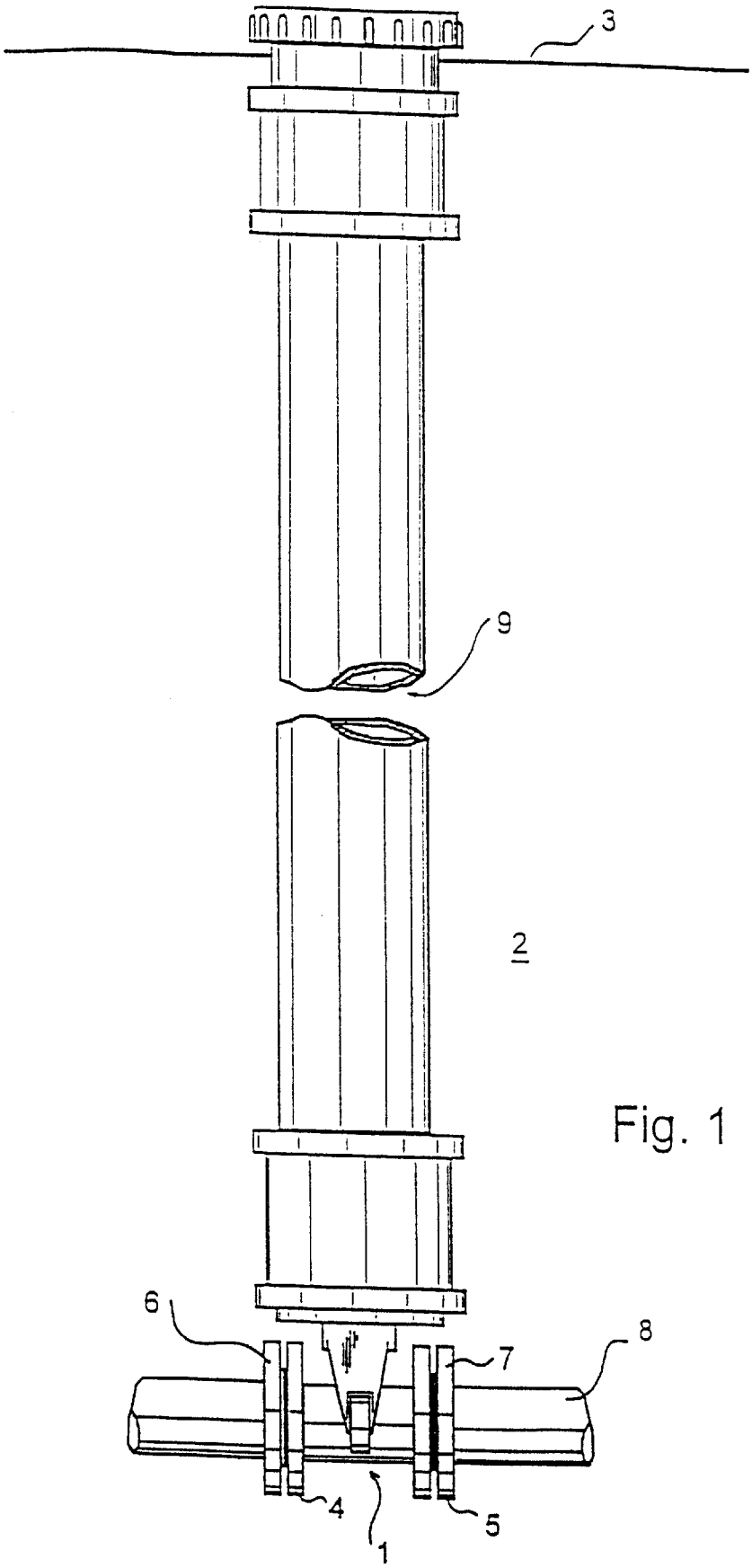
FIG. 1 is a view of an underground stop valve and a first embodiment of the inventive arrangement.
Figure 2:
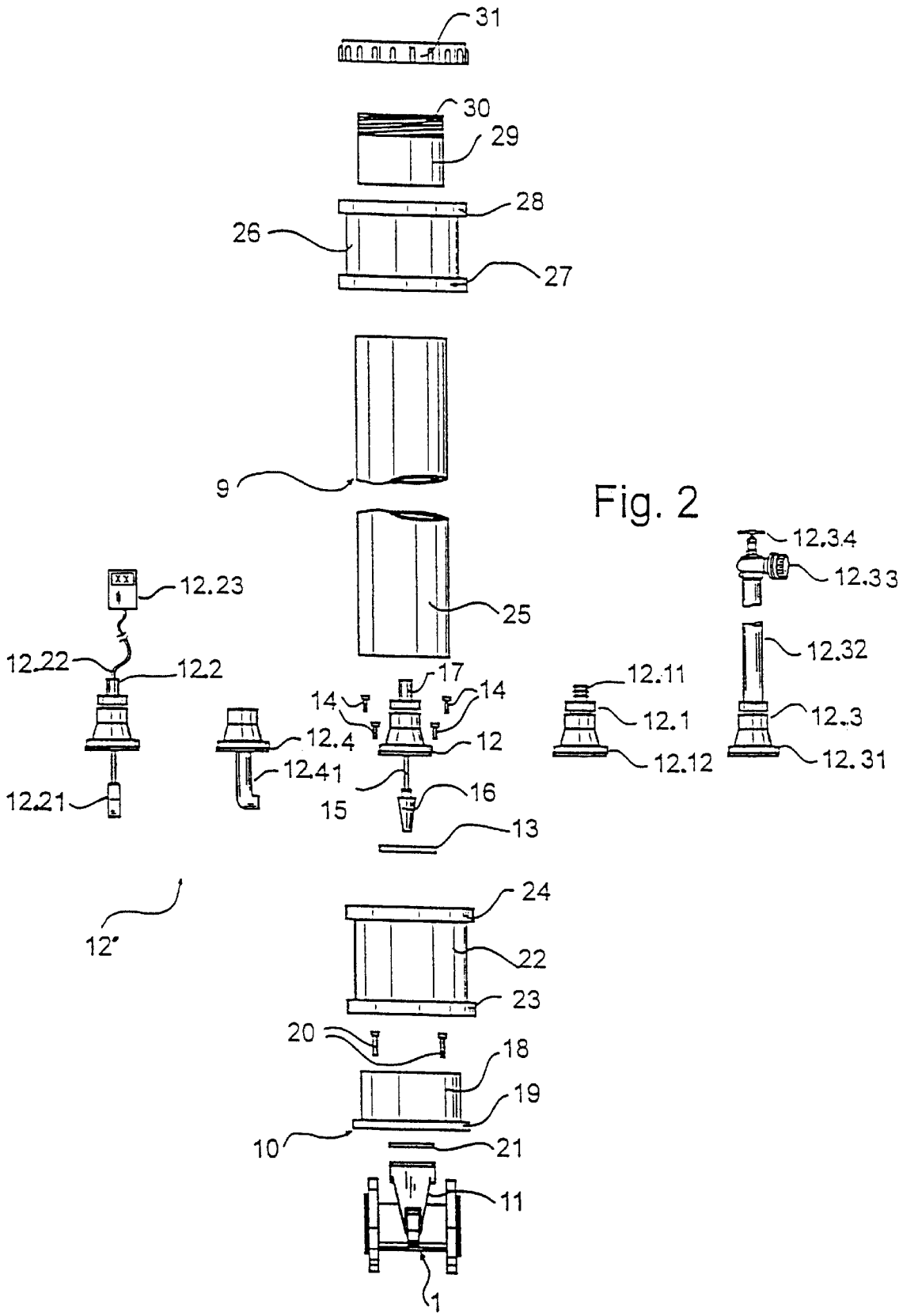
FIG. 2 is an exploded view of the inventive arrangement in FIG. 1.

FIGS. 1 and 2 show a first embodiment of the arrangement according to the invention, reference first being made to FIG. 1, in which the stop valve 1 is shown located in the ground 2.

The stop valve 1 is located in the ground 2 below the frost line a considerable distance below ground level 3. The valve 1 has flanges 4, 5 connecting it to corresponding flanges 6, 7 of a conduit 8 laid in the ground. The conduit 8 is in the Example shown a metal water conduit, but could also be some other type of liquid-conducting pipe, e.g. an insulated distant heating conduit or a conduit made of plastic, in which case neither this nor the stop valve need be provided with flanges.

On the valve 1 a tubular member 9 is mounted, which extends from the valve 1 up to ground level 3 where it is sealed.

The valve 1 and the tubular member 9 will below be described in more detail with reference to FIG. 2.

As appears from FIG. 2, the valve comprises a valve housing 11, on which a valve bonnet 12 can be mounted in a tight-fitting manner by means of an intermediate bonnet seal 13 and four bonnet bolts 14. The valve bonnet 12 supports a valve spindle 15, which in turn is connected to a slide 16. The slide 16 serves as stop means and fits a matching seat in the valve housing 11. The spindle 15 extends in a sealed but rotatable manner through the valve bonnet 12 and has at the top a square head 17. By means of a wrench rod it will thus be possible to rotate from ground level the valve spindle 15 and thus to operate the slide 16 of the valve 1.

In the shown first embodiment of the arrangement according to the invention, a collar 10 having a circular-cylindrical collar portion 18 and a flat bottom 19 is fastened between the valve bonnet 12 and the valve housing 11. The bottom 19 has suitable recesses for the valve spindle 15 with the slide 16 and for the bonnet bolts 14. The bottom 19 is retained on the valve housing by means of separate fixing bolts 20, with the aid of which a collar seal 21 is fixed between the collar 10 and the valve housing 11. The connection between the valve housing 11 and the collar 10 will thus be completely waterproof. The diameter of the collar portion 18 besides exceeds the diameter of the valve bonnet 12, which makes it possible to remove the valve bonnet from the valve housing 11 without necessitating dismounting of the collar 10.

On the collar 10 a pipe joint 22 is seated having at its ends flanges 23, 24, in which annular rubber seals (not shown) are mounted. By means of the rubber seal in the flange 23, the joint 22 can be connected to the collar 10 in a tight-fitting and somewhat elastic manner. At the opposite end of the pipe joint 22 a circular-cylindrical pipe is inserted, which has the same diameter as the collar portion 18 and, thanks to the rubber seal in the flange 24, is connected with the pipe joint 22 in a tight-fitting and somewhat elastic manner.

The upper end of the pipe 25 is correspondingly mounted in an upper pipe joint 26 having a lower flange 27 and an upper flange 28 which each support an internal annular rubber seal (not shown).

A threaded joint 29 is inserted into the upper pipe joint 26 from above and has at its top an external thread 30 and is at its bottom smooth for tight-fitting engagement with the seal in the flange 28.

The threaded joint suitably extends to ground level and can be sealed above ground level by means of a screw cap 31.

FIG. 2 also illustrates that a valve bonnet 12 can be replaced by a number of different elements, which, summing up, are designated pipe access means 12' and which are mountable on the valve housing 11 in a tight-fitting manner by means of the bonnet bolts 14 intended for the valve bonnet 12. A feature shared by the pipe access means 12' is that they make the conduit 8 lad in the ground 2 accessible for the following measures.

A first measure may comprise hydrostatic testing or cleaning of a selected piping portion by using a tube (not shown) which via the valve 1 is connected to the conduit 8. For this purpose use is made according to the invention of a tube coupling 12.1 having a lower part 12.12 fitting the valve housing 11 and an upper part 12.11 fitting said tube.

A second measure may comprise measuring of the flow of a medium flowing through the conduit 8. For this purpose use is made according to the invention of a flow meter 12.2 having at its bottom a measuring cell 12.21 which via a cable 12.22 is connected to an electric indicating unit 12.23.

A third measure may comprise controllable pumping-out of water (or any liquid whatever) flowing through the conduit 8. For this purpose use is made according to the invention of a hydrant 12.3 having a lower part 12.31 which fits the valve housing 11, a pipe 12.32, which at least extends up to ground level, and a water outlet 12.33 which is connected to a stop valve 12.34 integrated with the hydrant 12.3.

Finally, a fourth measure may comprise insertion of a video camera or a cleaning spiral with an associated nozzle (not shown) into the conduit 8. For this purpose use is made according to the invention of an insertion shaft 12.4 which at its bottom has a pipe bend 12.41 fitting the valve housing 11 at issue, and which at its top is fully open to enable from ground level easy insertion of said video camera or cleaning spiral.

Figure 3:
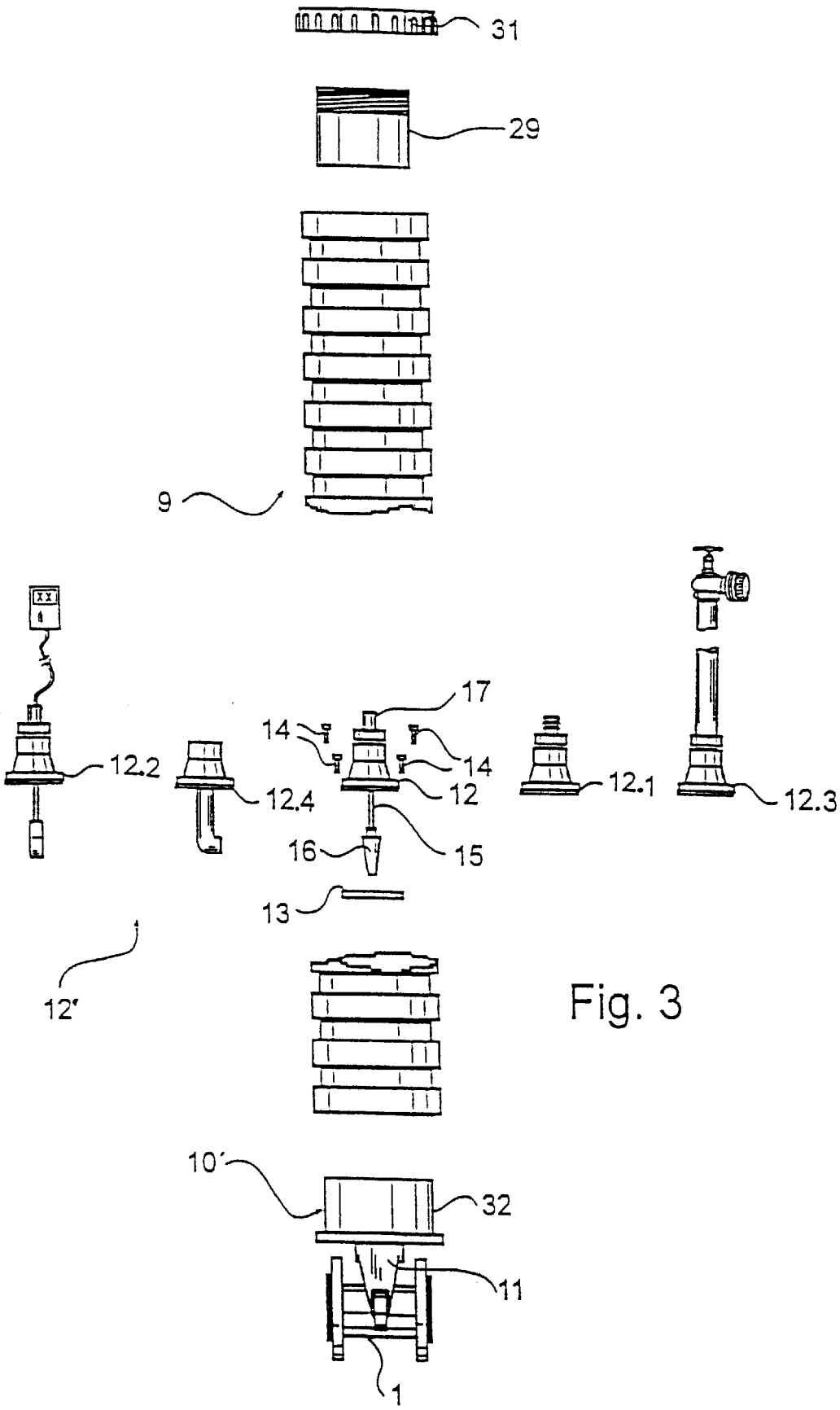
FIG. 3 is an exploded view of a second embodiment of the inventive arrangement.
Figure 4:
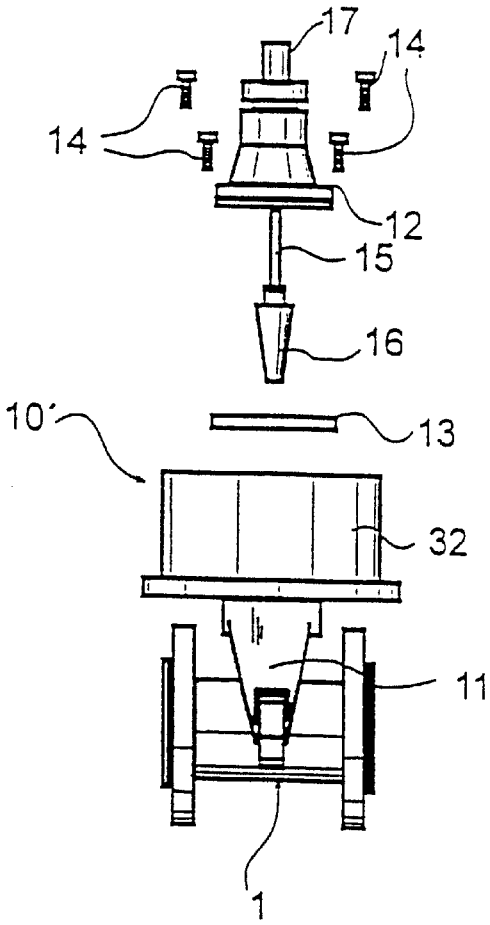
FIG. 4 is an exploded view and illustrates the valve of the second embodiment in more detail.
Figure 5:
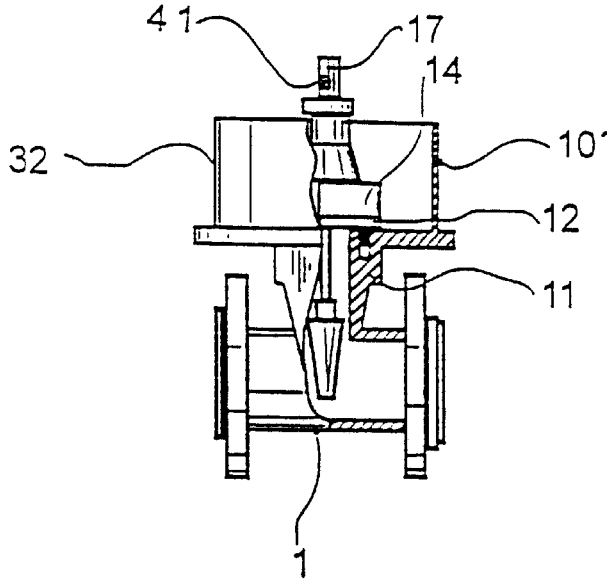
FIG. 5 is a part-sectional view and illustrates the valve of the second embodiment in the assembled state.

FIGS. 3, 4 and 5 show a second embodiment of the inventive arrangement.

When comparing FIGS. 2 and 3, it is obvious that the only difference between the two embodiments concerns the collar designated 10 in FIG. 2 and the tubular member designated 9 in FIG. 2. In the embodiment shown in FIG. 3, the collar instead constitutes an integrated part of the valve housing 11 of the valve 1, said part below being designated 10'. The part 10' has a collar portion 32 corresponding to the collar portion 18 described above, but the collar construction selected for the second embodiment means that the fixing bolts 20 as well as the collar seal 21 in the preceding embodiment can be excluded.

The second embodiment also comprises a special circular-cylindrical pipe 33 which is corrugated transversely of its longitudinal direction and is made of plastic and is elastically yieldable in said longitudinal direction, thus being able to absorb any motion in the ground without being damaged or itself damaging the subjacent valve 1. Also in this embodiment use is made of rubber seals (not shown) which in this case are mounted in annular, internal grooves formed by the corrugation of the pipe 33.

FIGS. 4 and 5 illustrate with the aid of the embodiment in FIG. 3 which parts are included in the valve bonnet 12 and how this is fixed to the valve housing 11. However, a detailed description in addition to the above description is not necessary for the expert to understand the construction. FIG. 5, however, should be carefully considered since it is obvious from the sectional part of this Figure that the collar portion 32 has a considerably greater diameter than the valve bonnet 12, thus making it possible to dismount this from the valve housing 11 without difficulties and raise it to ground level via the pipe 33. In this position the valve bonnet 12 can then be inspected, renovated, replaced by a new valve bonnet or be exchanged for one of the above-mentioned pipe access means 12' which is mounted on the valve housing 11 via the pipe 33.

It will be appreciated that for dismounting and subsequent mounting a suitable tool is required, which has a spindle for rotating the bonnet bolts 14 and some kind of means for removing the valve bonnet 12. Such a tool will now be described in more detail with reference to FIGS. 6 and 7.

FIG. 6 shows a tool 34 comprising a shaft 35 made up of several parts, and a plurality of exchangeable tool heads, such as socket wrenches 36 of various dimensions for different bonnet bolts, a socket 37 fitting the square head 17 of the valves in FIGS. 2 and 3 and being adapted to control these valves, and a special inventive tool head 38, which also fits said square head 17 and is adapted to serve as a puller.

FIG. 7 is a sectional view of the tool head 38. As will be seen, the tool head has an inner space 39 which corresponds to the square head 17 and into which a pin 40 is insertable. The pin 40 is adapted to engage in a hole 41 formed in the square head 17 and illustrated in FIG. 5. The pin 40 is mounted on one arm of a lever 42, which is pivoted about a horizontal shaft 43 and whose other arm is by means of a mounting 44 connected to a pull wire 45. The pull wire 45 extends via a deflecting roller 46 up to ground level to permit from there pivoting of the lever 42 and the pin 40 mounted thereon.

The pin 40 can thus take two different positions, more specifically an engaging position, which in FIG. 7 is indicated by full lines and in which the pin 40 projects into the space 49 for engaging a square head 17 therein, and a disengaging position, which in FIG. 7 is indicated by dashed lines and in which the pin 40 is moved out of the space 39 for disengaging a square head 17 therein. The lever 42 is, preferably by means of a helical spring 47, biased towards the engaging position, and the end 48 of the pin 40 facing the space 39 is suitably bevelled to enable engagement by snap action with the hole 41 of the square head 17.

Finally, the tool head 38 is also at its top formed with a recess 49 which is intended for connection with the shaft 35 of the tool 34 in a manner resisting rotation and pulling, thereby enabling the tool to serve as a puller.

It will be appreciated that the inventive arrangement may also comprise other pipe access means 12' than those described above, and that also the tool 34 need not necessarily have the described appearance to be within the scope of the invention.

What is claimed is:

1. An arrangement for a stop valve (1), adapted for location below ground level (3) and connection to a pipeline system (8) laid in the ground (2), said arrangement comprising a valve housing (11) and a valve bonnet (12) which is separably engaged to the housing by fixing means (14), wherein a valve spindle (15) supporting a moveable stop means (16) is rotatably engaged to the valve bonnet (12) and;

a tubular member (9) extending from the valve (1) up to the ground level (3) to enable operation of the valve spindle (15) from the ground level, and, a collar means (10, 10') which is tightly connected with and supported by the valve housing (11) and has a collar portion (18, 32) which surrounds the valve bonnet (12) and the fixing means (14) and is tightly connected with the lower end of the tubular member (9), a diameter of the tubular member (9) essentially corresponding to the diameter of the collar portion (18, 32), wherein pipe access means (12') for measuring conditions or cleaning within the pipeline can be selectively interchanged though the tubular member and collar means for the valve bonnet (12) including the valve spindle and movable stop means and engaged to the housing by the fixing means.

2. An arrangement as claimed in claim 1, wherein a diameter of the tubular member and the collar means is greater than that of the valve bonnet and pipe access means.

3. An arrangement for a stop valve (1), adapted for location below ground level (3) and connection to a pipeline system (8) laid in the ground (2), said arrangement comprising a valve housing (11) and a valve bonnet (12) which is separably engaged to the housing by fixing means (14), wherein a valve spindle (15) supporting a moveable stop means (16) is rotatably engaged to the valve bonnet (12) and;

a tubular member (9) extending from the valve (1) up to the ground level (3) to enable operation of the valve spindle (15) from the ground level, and, a collar means (10, 10') which is tightly connected with and supported by the valve housing (11) and has a collar portion (18, 32) which surrounds the valve bonnet (12) and the fixing means (14) and is tightly connected with the lower end of the tubular member (9), a diameter of the tubular member (9) essentially corresponding to the diameter of the collar portion (18, 32), wherein pipe access means (12') for measuring conditions or cleaning within the pipeline can be selectively interchanged though the tubular member and collar means for the valve bonnet (12) including the valve spindle and movable stop means and engaged to the housing by the fixing means, the arrangement further comprising, a tool (34), which has a tool shaft (35), whose length at least corresponds to the length of the tubular member (9), and a tool head (38) which is adapted to raise the valve bonnet (12) and which has a recess (39) corresponding to a projecting stud (17) of the valve spindle (15), and a pin (40) which is movable transversely of the longitudinal direction of the valve spindle (15) and which is adapted to engage, in an engaging position, in a corresponding hole (41) in said stud (17).

4. An arrangement as claimed in claim 2, characterized in that the pipe access means (12') is a tube coupling (12.1), which for hydrostatic testing or cleaning of the pipeline system (8) enables connection of a tube connected to a source of pressure with a pressure gauge.

5. An arrangement as claimed in claim 3, characterized in that the pipe access means (12') is a flow meter (12.2) for measuring the flow of a medium flowing through the pipeline system (8), and has a measuring cell (12.21) which in the valve housing (11) takes the place intended for the stop means (16).

6. An arrangement as claimed in claim 3, characterized in that the pipe access means (12') is a hydrant (12.3), which for controllable pumping out of water flowing through the pipeline system (8) has an integral stop valve (12.34) and at least one tube connection (12.33).

7. An arrangement as claimed in claim 3, characterized in that the pipe access means (12') is an insertion shaft (12.4) which is adapted to guide an object, such as a video camera or a cleaning spiral with an associated nozzle, inserted from ground level (3) into the insertion shaft (12.4), in the desired direction into the pipeline system (8).

8. An arrangement as claimed in claim 3, characterized in that tubular member (9) comprises a pipe (33) which is corrugated transversely of its longitudinal direction and thus is elastically yieldable in said longitudinal direction.

9. An arrangement as claimed in claim 3, characterized in that the collar means (10') in integrated with the valve housing (11).

10. An arrangement as claimed in claim 3, characterized in that the collar means (10) has an end wall (19), which is placed between the valve bonnet (12) and the valve housing (11) and through which extend the valve spindle (15) and the fixing means, which consists of bonnet bolts (14).

11. An arrangement as claimed in claim 3, characterized in that the pin (40) of the tool head (38) is by means of a spring (47) biased towards its engaging position, and that said pin (40) is, by means of a pull wire (45) whose length at least corresponds to the length of the tubular member (9), disengageable from the hole (41) in the stud (17) of the valve spindle.

* * * * *